US005738545A

United States Patent [19]

Igarashi et al.

[11] Patent Number: 5,738,545

[45] Date of Patent: Apr. 14, 1998

[54] CONNECTION DEVICE WHICH IS ELECTROMAGNETICALLY SHIELDED WITH SIMPLE STRUCTURE

[75] Inventors: Isao Igarashi; Nobukazu Kato, both of Tokyo, Japan

[73] Assignee: Japan Aviation Electronics Industry, Limited, Tokyo, Japan

[21] Appl. No.: 795,600

[22] Filed: Feb. 5, 1997

[30] Foreign Application Priority Data

Feb. 21, 1996 [JP] Japan ..... 8-033975

[51] Int. Cl.[6] ..... H01R 13/648

[52] U.S. Cl. ..... 439/607; 439/492

[58] Field of Search ..... 439/78, 83, 492–495, 439/607–610

[56] References Cited

U.S. PATENT DOCUMENTS 5,584,718 12/1996 Sukegawa ..... 439/607 X 5,586,911 12/1996 Miller et al. ..... 439/608 X 5,622,522 4/1997 Tan et al. ..... 439/607

5,622,523 4/1997 Kan et al. ..... 439/607

*Primary Examiner*—Khiem Nguyen

*Attorney, Agent, or Firm*—Laff, Whitesel, Conte & Saret, Ltd.

[57] ABSTRACT

In a connection device for connecting a flat cable with a connection object, a first connector is provided with a pressing member movably connected to a first insulator. The pressing member and the first insulator are covered with a first and a second conductive shell, respectively. The second conductive shell is brought into contact with a supplementary pattern of the flat cable and with the first conductive shell when the pressing member presses a flat cable with being moved. A second connector is provided with a third conductive shell for being connected to a supplementary pattern of the connection object. The third conductive shell is brought into contact with the first conductive shell when the first and the second connectors are connected to each other.

10 Claims, 8 Drawing Sheets

CONNECTION DEVICE WHICH IS ELECTROMAGNETICALLY SHIELDED WITH SIMPLE STRUCTURE

BACKGROUND OF THE INVENTION

This invention relates to a connection device for connecting a flat-shaped cable or a flat cable with a connection object, such as a printed board or another flat cable. The connection device comprises a first connector adapted to be connected to the flat cable and a second connector adapted to be connected between the first connector and the connection object. As each of the flat cables, use is made of a flexible flat cable, such as an FPC (flexible printed circuit), an FFC (flexible flat cable), or the like. Therefore, the FPC, the FFC, or the like will collectively be called hereinunder a flat cable.

Recently, a personal computer uses particular signals of high frequencies. This results in easy emission of an electromagnetic noise from the personal computer in the form of radio waves. The electromagnetic noise unfavorably influences electronic equipments adjacent to the personal computer. In order to avoid the unfavorable influences, particular measures are required.

In conventional measures, shielding structure covers the personal computer or each of the electronic equipments to electromagnetically shield them. With this conventional measures, however, the shielding structure becomes complicated to result in raising its manufacturing cost.

In the manner known in the art, each of the particular signals is transmitted generally through a flat cable and a connection device for connecting the flat cable. The flat cable has simple structure and therefore can be electromagnetically shielded in the relatively ready manner. However, it is relatively difficult to electromagnetically shield the connection device. This is because the connection device has structure which is complicated relative to that of the flat cable.

Under the circumstances, a conventional connection device is not electromagnetically shielded. Accordingly, the electromagnetic noise is emitted mainly from the connection device whenever each of the particular signal is transmitted through the flat cable and the connection device.

SUMMARY OF THE INVENTION

It is therefore an object of this invention to provide a connection device which is electromagnetically shielded with a simple structure.

Other object of this invention will become clear as the description proceeds.

A connection device to which this invention is applicable is for connecting a flat cable with a connection object. The flat cable has a main pattern on a main surface thereof and a supplementary pattern on a supplementary surface thereof opposite to the main surface. The connection object has a main pattern and a supplementary pattern. The connection device comprises a first connector and a second connector adapted to be connected to the first connector in a predetermined direction. In the connection device, the first connector comprises a first insulator having an opening for receiving the flat cable, a first contact held to the first insulator, a pressing member movably connected to the first insulator for pressing the flat cable to make the main pattern of the flat cable become in contact with the first contact with the pressing member being moved relative to the first insulator, a first conductive shell covering the first insulator, and a second conductive shell covering the pressing member for being connected to the supplementary pattern of the flat cable. The second conductive shell is brought into contact with the first conductive shell when the pressing member presses the flat cable. On the other hand, the second connector comprises a second insulator and a second contact held to the second insulator for being connected to the main pattern of the connection object. The second contact is brought into contact with the first contact when the first and the second connectors are connected to each other. The second connector further comprises a third conductive shell covering the second insulator for being connected to the supplementary pattern of the connection object. The third conductive shell is brought into contact with the first conductive shell when the first and the second connectors are connected to each other.

DESCRIPTION OF THE PREFERRED EMBODIMENTS

Figure 1:
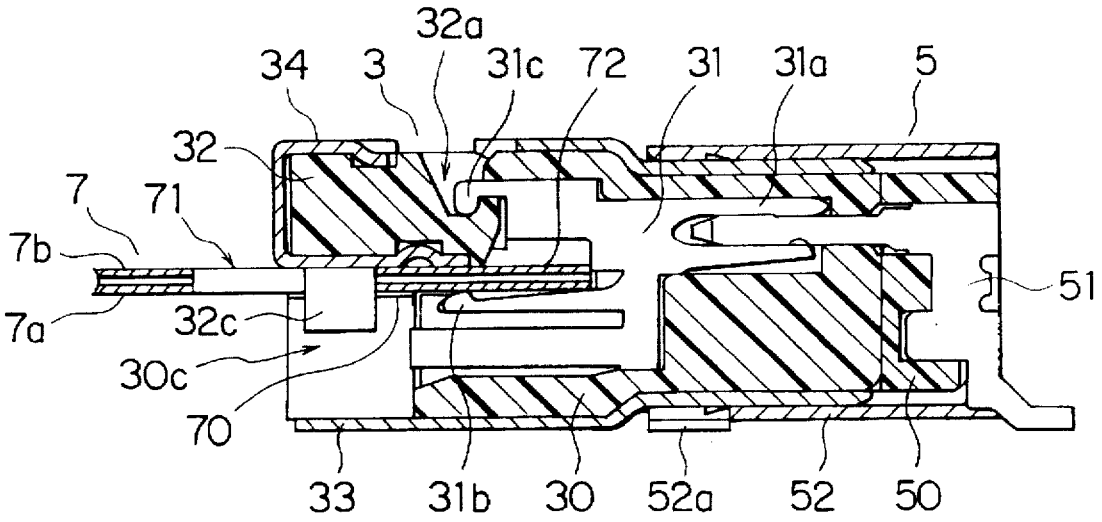
FIG. 1 is a sectional view of a connection device according to a first embodiment of this invention, comprising a first and a second connector connected to each other, wherein the first connector is connected to a flat cable.
Figure 2:
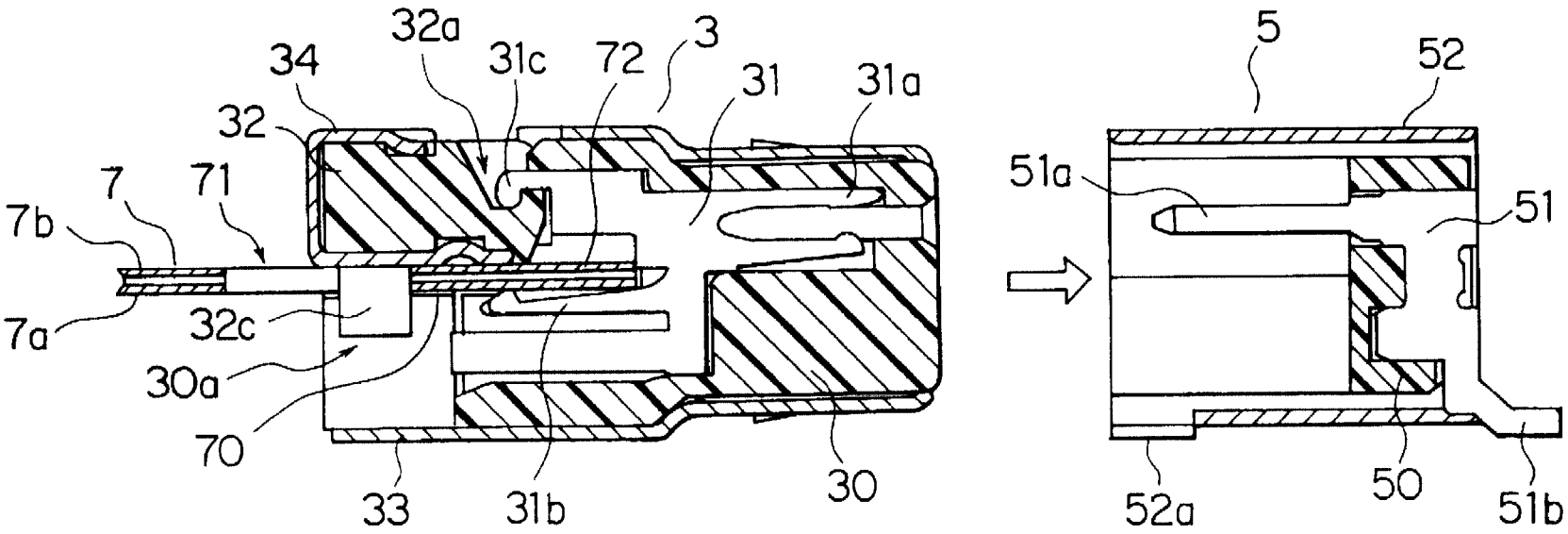
FIG. 2 is a sectional view of the connection device illustrated in FIG. 1, wherein the first and the second connectors are disconnected from one another.

Referring to FIGS. 1 and 2, description will be made as regards a connection device according to a first embodiment of this invention. The connection device is for connecting a flexible cable 7 with a printed board (not shown) which is referred to as a connection object. The flexible cable 7 is of a flat shape and therefore may be called a flat cable. The flexible cable 7 has a main pattern on a main or lower surface 7*a* thereof and a supplementary pattern on a supplementary or upper surface 7*b* thereof opposite to the lower surface. The main pattern is used as a signal pattern 70 for transmitting an electric signal therethrough. The supplementary pattern serves as a shield pattern 72 for electromagnetically shielding the main pattern. In the manner known in the art, the printed board is provided with a main and a supplementary pattern which serve as a signal circuit and an earth circuit, respectively.

The connection device comprises a cable side connector 3 and a printed board side connector 5 which are adapted to be connected to each other in a predetermined direction. The cable side connector 3 is referred to as a first connector. The printed board side connector 5 is referred to as a second connector.

Figure 3:
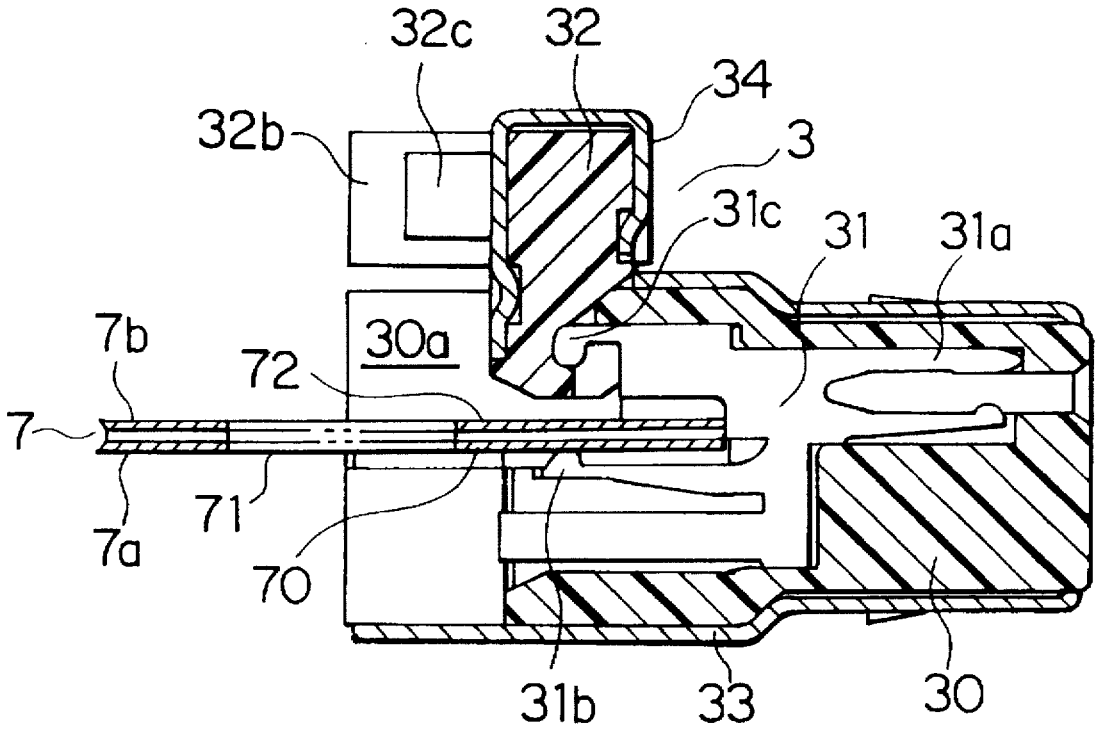
FIG. 3 is a sectional view for describing a connection/disconnection between the first connector and the flat cable in the connection device of FIGS. 1 and 2.
Figure 4:
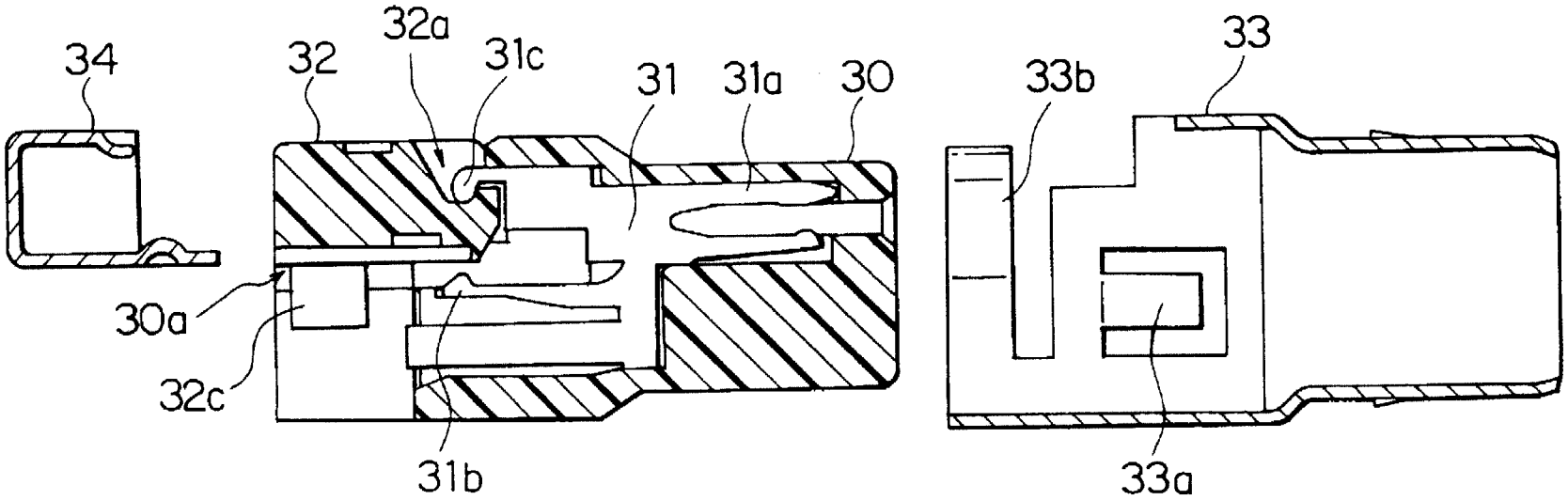
FIG. 4 is an exploded sectional view of the first connector in the connection device of FIGS. 1 and 2.
Figure 5:
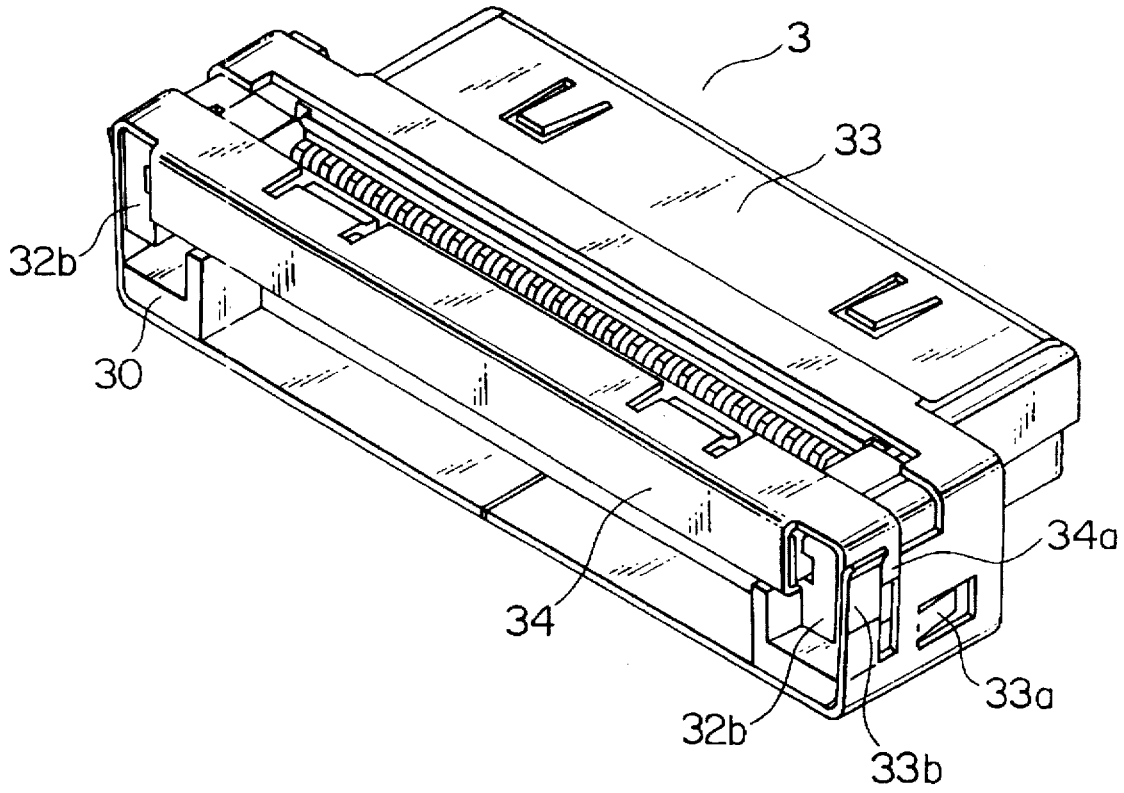
FIG. 5 is a perspective view of the first connector connection device of FIGS. 1 and 2.

Referring to FIGS. 3 through 5 in addition, the description will be made as regards the cable side connector 3. The cable side connector 3 is connected to the flexible cable 7. The cable side connector 3 has a cable side insulator 30, a plurality of conductive cable side contacts 31, a pressing member 32, a first conductive shell 33, and a second conductive shell 34. The cable side insulator 30 is referred to as a first insulator. Each of the cable side contacts 31 is referred to as a first contact.

The cable side insulator 30 has an opening 30*a* at the opposite side of its engaging side. Through the opening 30*a*, one end portion of the flexible cable 7 is inserted or received into the cable side insulator 30. The flexible cable 7 extends along a predetermined plane parallel to the predetermined direction.

The cable side contacts 31 are arranged in a line in the cable side insulator 30. Each of the cable side contacts 31 is of a socket-type and has a contact portion 31*a*, a terminal portion 31*b*, and a pivotally supporting portion 31*c*. The contact portion 31*a* is adapted to become in contact with a predetermined one of printed board side contacts 51 which will later be described. The terminal portion 31*b* is for being in contact with the signal pattern 70. The pivotally supporting portion 31*c* is engaged with the pressing member 32 to rotatably support the pressing member 32. In other words, the pressing member 32 is pivotal around a predetermined axis which intersects the predetermined direction and is parallel to the predetermined plane.

The pressing member 32 is made of insulating material and has a concave portion 32*a* which is formed at a front end portion of the pressing member 32 and adapted to be engaged with the pivotally supporting portion 31*c* of the cable side contact 31. By this engagement, the pressing member 32 is pivotally supported by the pivotally supporting portion 31*c* in the above-described manner so as to be rotatable with respect to the cable side insulator 30. In addition, by the rotation of the pressing member 32, the pressing member 32 opens and closes the upper portion of the opening 30*a* of the cable side insulator 30. Further, the pressing member 32 presses one end portion of the flexible cable 7 against the cable side contact 31 when the upper portion of the opening 30*a* is closed.

The pressing member 32 has side walls 32*b* at each of both sides thereof in a first direction which is perpendicular to the predetermined direction and parallel to the predetermined plane. Convex portions 32*c* are formed inside of the side walls 32*b*, respectively.

Figure 6:
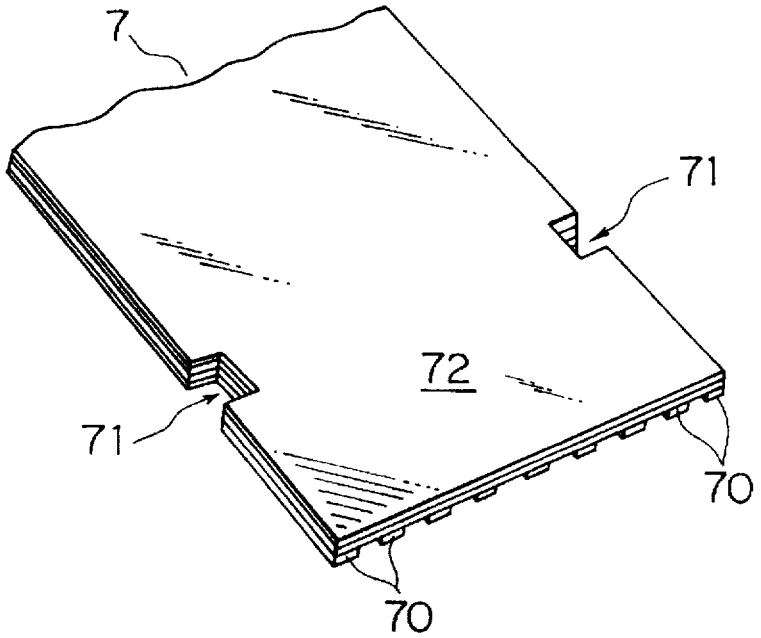
FIG. 6 is a perspective view showing the essential part of the flat cable.

Referring to FIG. 6 shortly, the cable 7 has a pair of edge portions each extending in the predetermined direction. Notches 71 are formed to the edge portions, respectively.

When the pressing portion 32 closes the opening 30*a*, the convex portions 32*c* are inserted into the notches 71 to be engaged with the cable 7. Once this condition is achieved, the pressing member 32 will not be opened even if the flexible cable 7 is pulled. Accordingly, the flexible cable 7 can no longer be pulled out. Each of the notches 71 will be referred to as a first engaging portion. Each of the convex portions 32*c* will be referred to as a second engaging portion.

Figure 6A:
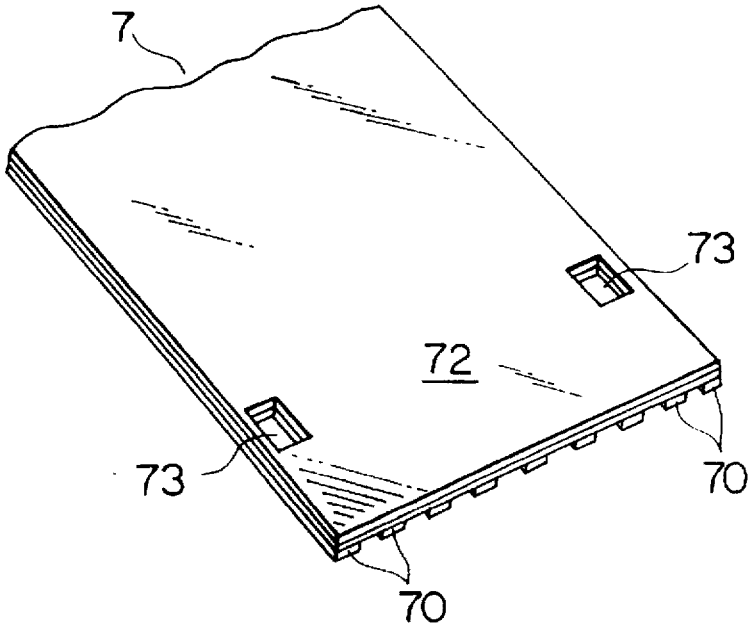
FIG. 6A is a perspective view showing the essential part of a modification of the flat cable.
Figure 7:
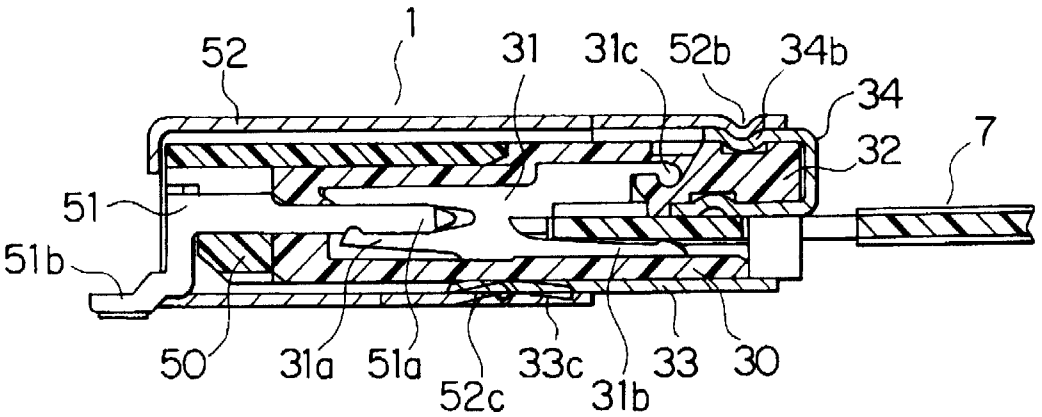
FIG. 7 is a sectional view of a connection device according to a second embodiment of this invention, comprising a first and a second connector connected to each other, wherein the fist connector is connected to a flat cable.
Figure 8:
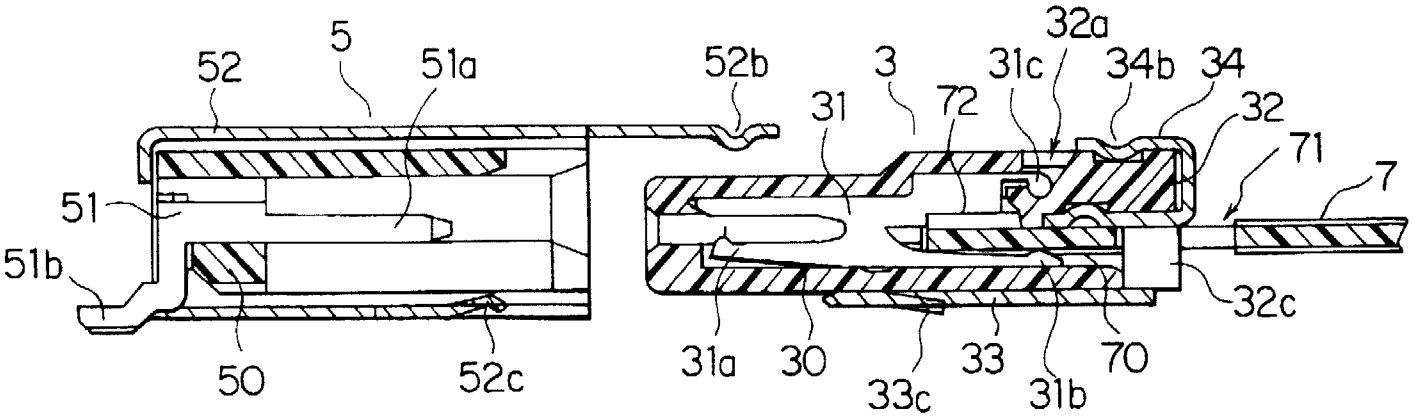
FIG. 8 is sectional view of the connection device illustrated in FIG. 7, wherein the first and the second connectors are disconnected from one another.
Figure 9:
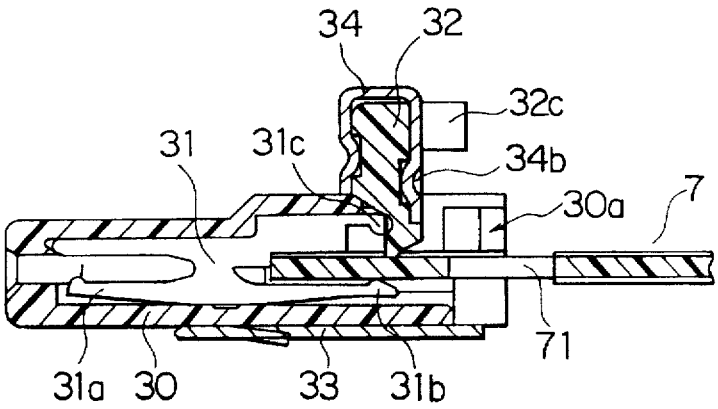
FIG. 9 is sectional view for describing a connection/disconnection between the first connector and the flat cable in the connection device of FIGS. 7 and 8.
Figure 10:
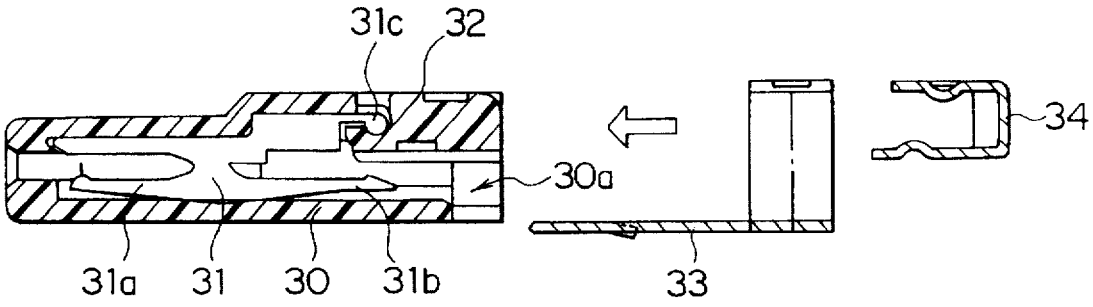
FIG. 10 is an exploded sectional view of the first connector in the connection device of FIGS. 7 and 8.

Referring to FIG. 6*a* together with FIGS. 3 and 4, through holes 73 may be made instead of the notches in the flat cable 7 for engaging with the pressing portion 32.

Returning back to FIG. 5, the first conductive shell 33 covers the cable side insulator 30. The first conductive shell 33 has opposite side walls in each of which an engaging portions 33*a* is formed for engaging with the cable side insulator 30.

In addition, the first conductive shell 33 has a contact portion 33*b* at an end thereof in the first direction. On the other hand, the second conductive shell 33 covers the pressing member 32 and has a contact portion 34*a* at an end thereof in the first direction. When the opening 30*a* of the pressing member 32 is closed with the pressing member 32 being pivoted around the predetermined axis to press the cable 7 against the first contact 31, the contact portion 34*a* of the second conductive shell 34 is brought in contact with the contact portion 33*b* of the first conductive shell 33. In this event, the bottom surface of the second conductive shell 34 is in contact with the shield pattern 72 of the flexible cable 7.

Referring to FIG. 4 mainly, the description will now be directed to an assembling process of the above-mentioned cable side connector 3.

First, the cable side contact 31 is pressed into the cable side insulator 30. The pressing member 32 is covered with the second conductive shell 34, and the concave portion 32*a* is engaged with the pivotally supporting portion 31*c* of the cable side contact 31 in such manner that the concave member 32*a* of the pressing member 32 is disposed at the lower end. Thereafter, the cable side insulator 30 is covered with the first conductive shell 33. Finally, the front end of the flexible cable 7 is inserted into the cable side insulator 30 through the opening 30*a*, then, while the pressing member 32 is being rotated towards the flexible cable 7, the convex portion 32*c* of the pressing member 32 is inserted into the notch 71 of the flexible cable 7. The signal pattern 70 exposed at the front end portion of the flexible cable 7 is brought in press contact with the terminal portion 31*b* of the cable side contact 31 by the pressing member 32, and the second conductive shell 34 is also brought in press contact with the shield 72 of the flexible cable 7. The cable side connector 3 is assembled by following the above described procedure.

The description will now be directed to the printed board side connector 5. The printed board side connector 5 comprises a printed board side insulator 50, the printed board side contacts 51, and a third conductive shell 52. The printed board side insulator 50 is referred to as a second insulator. Each of the printed board side contacts 51 is referred to as a second contact.

The printed board side insulator 50 is placed on the printed board (not shown). The printed board side insulator 50 is of a substantially rectangular parallelepiped shape.

The printed board side contacts 51 are pressed into the printed board insulator 50 so as to be corresponding to the cable side contacts 31 of the cable side connector 3. Therefore, the contacts 51 and contacts 31 are brought in contact with one another when the cable side connector 3 is connected to the printed board side connector 5 in the predetermined direction.

Each of the printed board side contacts 51 is of a pin-type and has a contact portion 51*a* and a terminal portion 51*b*. The contact portion 51*a* is adapted to become in contact with the contact portion 31*a* of the cable side contact 31. The terminal portion 51*b* is for being soldered on the signal circuit of the printed board.

The third conductive shell 52 covers the printed board side insulator 50, surrounds the contact portion 51*a* protruded from the printed board side insulator 50, and further, receives an end portion of the engaging side of the cable side connector 3. The third conductive shell 52 has a connecting portion 52*a* to be soldered on the earth circuit formed on the printed board. In addition, while the third conductive shell 52 receives the end portion of the engaging side of the cable side connector 3, the third conductive shell 52 is brought in contact with the first conductive shell 33. While the cable side connector 3 is connected to the printed board side connector 5, the first, the second, and the third conductive shells 33, 34, and 52 of FIGS. 1 and 2 are grounded, thereby the connection device obtains electromagnetic shield effect known in the art.

Turning to FIGS. 7 through 10, the description will be made as regards a connection device according to a second embodiment of this invention. The connection device comprises similar parts designated by like reference numerals.

In the connection device, the first conductive shell 33 covers the rear end portion and the bottom surface of the cable side insulator 30 and does not cover the upper surface of the cable side insulator 30. Instead, the upper surface of the third conductive shell 52 is extended to cover the upper surface of the cable side insulator 30 when the cable side connector 3 is connected to the printed board side connector 5. With this structure, the first and the third conductive shells 33 and 52 cooperates with each other to substantially cover a combination of the cable side and the printed board side connectors 3 and 5 when the cable side and the printed board side connectors 3 and 5 are connected to each other.

In addition, contact portions 52*b* and 52*c* are respectively formed on the upper surface of the front end portion of the third conductive shell 52 and on the bottom surface of the front end portion thereof, respectively. Each of the contact portions 52*b* and 52*c* extends in the predetermined direction. A contact portion 33*c* is formed on the bottom surface of the first conductive shell 33 to extend in the predetermined direction. The contact portion 33*c* of the first conductive shell 33 is for being in contact with the contact portion 52*c* of the third conductive shell 52 when the cable side connector 3 is connected to the printed board side connector 5. Similarly, a contact portion 34*b* is formed on the second conductive shell 34 to extend in the predetermined direction. The contact portion 34*b* of the second conductive shell 34 is for being in contact with the contact portion 52*b* of the third conductive shell 52 when the cable side connector 3 is connected to the printed board side connector 5. Further, the side surface of the second conductive shell 34 becomes in contact with the first conductive shell 33.

While the present invention has thus far been described in connection with a few embodiments thereof, it will readily be possible for those skilled in the art to put this invention into practice in various other manners. For example, the connection object may be a flat cable, such as an FPC, an FFC, or the like.

What is claimed is:

1. A connection device for connecting a flat cable with a connection object, said flat cable having a main pattern on a main surface thereof and a supplementary pattern on a supplementary surface thereof opposite to said main surface, said connection object having a main pattern and a supplementary pattern, said connection device comprising a first connector and a second connector adapted to be connected to said first connector in a predetermined direction, said first connector comprising:

a first insulator having an opening for receiving said flat cable;

a first contact held to said first insulator;

a pressing member movably connected to said first insulator for pressing said flat cable to make said main pattern of the flat cable become in contact with said first contact with said pressing member being moved relative to said first insulator;

a first conductive shell covering said first insulator; and a second conductive shell covering said pressing member for being connected to said supplementary pattern of the flat cable, said second conductive shell being brought into contact with said first conductive shell when said pressing member presses said flat cable;

said second connector comprising:

a second insulator;

a second contact held to said second insulator for being connected to said main pattern of the connection object, said second contact being brought into contact with said first contact when said first and said second connectors are connected to each other; and a third conductive shell covering said second insulator for being connected to said supplementary pattern of the connection object, said third conductive shell being brought into contact with said first conductive shell when said first and said second connectors are connected to each other.

2. A connector as claimed in claim 1, wherein said flat cable is received in said opening of the first insulator to extend along a predetermined plane parallel to said predetermined direction, said pressing member being pivotal around a predetermined axis which intersects said predetermined direction and is parallel to said predetermined plane.

3. A connector as claimed in claim 2, wherein said first contact has a pivotally supporting portion for supporting said pressing member so as to be pivotal around said predetermined axis.

4. A connector as claimed in claim 2, wherein said first conductive shell has a contact portion at an end thereof in a first direction which is perpendicular to said predetermined direction and parallel to said predetermined plane, said second conductive shell having a contact portion at an end thereof in said first direction, said contact portion of the second conductive shell being brought into contact with said contact portion of the first conductive shell with said pressing member being pivoted around said predetermined axis to press said cable against said first contact.

5. A connector as claimed in claim 1, wherein said first and said third conductive shells are fitted to become in contact with to each other when said first and said second connectors are connected to each other.

6. A connector as claimed in claim 1, wherein said first conductive shell has a contact portion extending in said predetermined direction, said third conductive shell having a contact portion which extends in said predetermined direction and is brought into contact with said contact portion of the first conductive shell when said first and said second connectors are connected to each other.

7. A connector as claimed in claim 6, wherein said first and said third conductive shells cooperate with each other to substantially cover a combination of said first and said second insulators when said first and said second connectors are connected to each other.

8. A connector as claimed in claim 1, wherein said flat cable has a first engaging portion, said pressing member having a second engaging portion for being engaged with said first engaging portion in said predetermined direction.

9. A connector as claimed in claim 8, wherein said flat cable has a pair of edge portions each extending in said predetermined direction, said first engaging portion is a notch formed to at least one of said edge portions, said second engaging portion being inserted into said notch when said pressing member presses said flat cable.

10. A junction connector having a shield structure as claimed in claim 8, wherein said first engaging portion has a through hole communicating between said main and said supplementary surfaces, and said second engaging portion being inserted into said through hole when said pressing member presses said flat cable.

* * * * *